US011304514B2

(12) United States Patent
Lanphear

(10) Patent No.: US 11,304,514 B2
(45) Date of Patent: Apr. 19, 2022

(54) SHELVING SYSTEM WITH TILTING SHELVES AND ADJUSTABLE DIVIDERS

(71) Applicant: John Stephen Lanphear, Lawrence, MI (US)

(72) Inventor: John Stephen Lanphear, Lawrence, MI (US)

( * ) Notice: Subject to any disclaimer, the term of this patent is extended or adjusted under 35 U.S.C. 154(b) by 0 days.

(21) Appl. No.: 17/186,612

(22) Filed: Feb. 26, 2021

(65) Prior Publication Data

US 2021/0298470 A1 Sep. 30, 2021

Related U.S. Application Data

(60) Provisional application No. 62/994,764, filed on Mar. 25, 2020.

(51) Int. Cl.

| | |
|---|---|
| ***A47B 57/58*** | (2006.01) |
| ***A47F 5/00*** | (2006.01) |
| ***A47B 96/04*** | (2006.01) |
| ***A47B 96/20*** | (2006.01) |
| ***A47B 96/02*** | (2006.01) |

(52) U.S. Cl.

CPC ..... *A47B 57/583* (2013.01); *A47B 57/586* (2013.01); *A47B 96/021* (2013.01); *A47B 96/04* (2013.01); *A47B 96/201* (2013.01); *A47F 5/005* (2013.01)

(58) Field of Classification Search

CPC ... A47B 57/583; A47B 96/021; A47B 96/201; A47B 57/58; A47B 57/585; A47B 57/588; A47B 57/586; A47B 65/10; A47B 65/15; A47B 96/04; A47B 47/022; A47B 96/027; A47F 5/005; A47F 5/132; A47F 7/144; A47F 5/0081; A47F 5/16; A47F 2005/165; A47F 5/0093

USPC ..... 211/175, 184, 90.02, 119.003, 59.4; 108/60, 61

See application file for complete search history.

(56) References Cited

U.S. PATENT DOCUMENTS

| | | | | | |
|---|---|---|---|---|---|
| 431,373 | A * | 7/1890 | Mendenhall | ..... | A47B 65/15 211/43 |
| 989,566 | A * | 4/1911 | Callaghan | ..... | A47B 57/58 108/61 |
| 1,165,703 | A * | 12/1915 | O'Connor | ..... | A47B 57/58 108/61 |
| 1,418,324 | A * | 6/1922 | O'Connor | ..... | B65D 25/04 220/532 |

(Continued)

*Primary Examiner* — Jennifer E. Novosad

(74) *Attorney, Agent, or Firm* — Diederiks & Whitelaw, PLC.

(57) ABSTRACT

A shelving system and its method of formation. The shelving system comprises a shelf including a support plate, a front edge lip connected to a front portion of the support plate, and a back support edge connected to a back portion of the support plate. The back support edge has an elongated slot. A divider is mounted on the support plate and includes a main portion having a first end and a second end, with a first tab attached to the main portion at the first end and engaging a slit in the front edge lip and a second tab attached to the main portion at the second end, the second tab being provided with a flange, said flange being formed with a hole. A fastener passes through the hole in the flange and the elongated slot in the back support edge to adjustably secure the divider to the shelf.

17 Claims, 4 Drawing Sheets

(56) References Cited

U.S. PATENT DOCUMENTS 1,450,191 A * 4/1923 Sturm ..... A47B 57/58 108/61
1,932,217 A * 10/1933 Kaufman ..... A47F 5/005 312/140
2,261,840 A * 11/1941 Bergmann ..... B42F 17/02 220/532
2,516,122 A * 7/1950 Hughes ..... A47B 57/583 211/184
2,527,277 A * 10/1950 Schade ..... A47B 65/10 211/42
2,639,040 A * 5/1953 Tapley ..... A47F 5/0068 211/119.003
2,658,628 A * 11/1953 Hilgen ..... A47B 57/58 211/184
2,884,139 A * 4/1959 Dunham ..... A47F 5/005 211/184
2,889,055 A * 6/1959 Weller ..... B42F 17/08 211/184
2,915,193 A * 12/1959 Bromberg ..... A47F 5/005 108/61
3,247,809 A 4/1966 Thomson
3,512,652 A * 5/1970 Armstrong ..... A47F 5/005 211/134
3,698,568 A * 10/1972 Armstrong ..... A47F 5/005 211/184
3,780,876 A * 12/1973 Elkins ..... A47F 5/005 211/184
3,830,169 A * 8/1974 Madey ..... G09F 5/04 108/61
3,872,976 A * 3/1975 Moore ..... A47F 5/005 211/184
3,905,484 A * 9/1975 Dean ..... A47B 57/58 211/184
4,476,985 A * 10/1984 Norberg ..... A47F 5/005 211/133.6
4,503,982 A * 3/1985 Lewis ..... A47F 5/005 108/61
4,538,737 A * 9/1985 Delaney ..... B60P 7/0892 206/560
4,552,272 A * 11/1985 Field ..... A47F 5/0846 108/61
4,615,276 A * 10/1986 Garabedian ..... A47F 5/005 108/61
4,682,696 A 7/1987 Shieu
4,728,158 A * 3/1988 D'Elia ..... A47B 57/06 211/184
4,759,449 A * 7/1988 Gold ..... A47B 57/58 211/184
4,782,960 A * 11/1988 Mavrakis ..... A47B 57/585 211/184
4,830,201 A * 5/1989 Breslow ..... A47F 1/126 211/184
4,896,779 A * 1/1990 Jureckson ..... A47F 5/005 211/184
5,078,280 A * 1/1992 Nordeen ..... B25H 5/00 211/119.003
5,082,125 A 1/1992 Ninni
5,207,334 A * 5/1993 Lear ..... A47J 47/16 211/184
5,255,802 A * 10/1993 Krinke ..... A47F 5/005 211/184
5,269,600 A * 12/1993 Arreola ..... A47B 88/975 312/348.3
5,287,974 A * 2/1994 Buday ..... A47B 57/58 211/175
5,381,908 A * 1/1995 Hepp ..... A47B 57/585 108/61
5,450,968 A * 9/1995 Bustos ..... A47F 5/005 108/108
5,489,031 A * 2/1996 Carroll ..... A47F 5/0068 211/134
5,582,305 A * 12/1996 Howell, Sr. ..... A47F 5/0006 211/126.1
5,711,435 A * 1/1998 Morison ..... A47F 5/08 211/90.01
5,738,019 A 4/1998 Parker
6,082,557 A * 7/2000 Leahy ..... A47B 57/58 211/184
6,234,328 B1 * 5/2001 Mason ..... A47B 57/045 211/150
6,311,855 B1 * 11/2001 Ali ..... A47F 5/005 211/133.6
6,389,991 B1 * 5/2002 Morrisson ..... A47B 57/585 108/61
6,705,477 B1 3/2004 Narkis et al.
D509,393 S * 9/2005 Winig ..... D6/574
7,128,379 B1 * 10/2006 LaBonia, Jr. ..... A47B 47/0075 312/351
7,216,770 B2 5/2007 Mueller et al.
8,517,191 B2 8/2013 Paeth
8,602,226 B1 * 12/2013 Chen ..... A47F 1/00 211/59.4
8,662,325 B2 3/2014 Davis et al.
D719,194 S 12/2014 Lee et al.
9,357,841 B2 6/2016 Obitts et al.
9,364,103 B2 6/2016 Crabtree, II
9,782,017 B1 10/2017 Luberto et al.
10,099,363 B1 10/2018 Hsieh
10,617,206 B2 * 4/2020 Brugmann ..... A47F 5/005
2001/0002659 A1 * 6/2001 Bada ..... A47F 5/005 211/59.2
2003/0034319 A1 * 2/2003 Meherin ..... A47F 5/005 211/184
2003/0192843 A1 * 10/2003 Winig ..... A47B 96/067 211/87.01
2005/0139560 A1 6/2005 Whiteside et al.
2005/0161418 A1 * 7/2005 Lynch ..... A47F 5/0056 211/119.003
2005/0224437 A1 * 10/2005 Lee ..... A47F 5/005 211/184
2006/0096938 A1 * 5/2006 Kanou ..... A47F 3/0486 211/184
2006/0260518 A1 * 11/2006 Josefsson ..... A47F 5/0068 108/61
2006/0278596 A1 12/2006 Parshad
2008/0302742 A1 * 12/2008 Fulmer ..... H05K 7/1425 211/59.4
2009/0278009 A1 * 11/2009 Nono ..... A47B 57/583 248/244
2010/0078402 A1 * 4/2010 Davis ..... A47B 57/585 211/184
2010/0258513 A1 * 10/2010 Meyer ..... A47F 5/005 211/59.3
2012/0305508 A1 * 12/2012 Brozak ..... A47F 5/0056 211/85.5
2013/0153524 A1 * 6/2013 Nilsson ..... A47F 5/00 211/153
2013/0213916 A1 * 8/2013 Leahy ..... A47F 5/005 211/151
2015/0223620 A1 * 8/2015 Nilsson ..... A47B 57/58 211/59.4
2017/0035218 A1 * 2/2017 Riley ..... A47F 1/126
2019/0183243 A1 * 6/2019 Brugmann ..... A47F 5/005
2021/0298470 A1 * 9/2021 Lanphear ..... A47F 5/005

* cited by examiner

SHELVING SYSTEM WITH TILTING SHELVES AND ADJUSTABLE DIVIDERS

CROSS REFERENCE TO RELATED APPLICATIONS

This application claims benefit of U.S. Provisional Patent Application No. 62/994,764, which was filed on Mar. 25, 2020 and is entitled "SHELVING SYSTEM TILTING WITH ADJUSTABLE DIVIDERS". The entire content of this application is incorporated herein by reference.

BACKGROUND OF THE INVENTION

The present invention relates to adjustable shelves used on workstations, tables, stationary racks or similar support systems. The shelves are typically used in industrial, commercial, and retail establishments but can also be adapted to any environment where items or products are stored. For example, shelves may be used for storing articles in a warehouse or displaying items in a store for sale. As a result, the shelves should be tiltable so a front of the shelf can be lowered for display of items stored on the shelf and also to allow the shelf to be easily loaded or unloaded. Also, the tilted shelves allow for products mounted thereon for sale to slide toward the front of the shelf as the products are dispensed. In addition, items placed on the shelves may be of different sizes. Therefore, adjustable dividers have been placed on such shelves to accommodate the different sized items. There has been a need in the art for shelves that both tilt and have adjustable dividers.

Some solutions to these problems have been proposed. For example, U.S. Pat. No. 6,234,328, incorporated herein by reference, discloses a shelf system having adjustable dividers and side brackets. U.S. Pat. No. 3,247,809, also incorporated herein by reference, discloses a shelf with a panel bent upwardly at a right angle at one edge and a flange bent downwardly at an opposite edge. However, such arrangements are relatively complicated to manufacture and to use in practice. Most arrangements are simply hard to adjust after manufacturing is complete. Therefore, there exists a need in the art for a shelving system that has a tiltable shelf and adjustable dividers that is easy to manufacture and to adjust.

SUMMARY OF THE INVENTION

The present invention is directed to a shelving system with tilting shelves and adjustable dividers. The shelving system comprises a tiltable shelf including a support plate for holding or storing items. The support plate extends in a longitudinal direction from a first side to a second side. The support plate also extends in a lateral direction from a lower front portion to an upper back portion such that the support plate is tilted forward and items stored on the support plate will slide toward the lower front portion.

A front edge lip is connected to the support plate. The front edge lip extends in the longitudinal direction and rises above the support plate to retain items on the support plate surface. The front edge lip has a series of slits formed therein. A back support edge is connected to the support plate along the upper back portion of the support plate. The back support edge has an elongated slot extending generally in the longitudinal direction.

Multiple dividers are mounted on the support plate. Each divider includes a main portion having a first end disposed at the front of the shelf and a second end located at the back of the shelf. A first tab is attached to the main portion of each divider at the first end of the main portion and engages one of the slits in the front edge lip. A second tab is attached to the main portion of each divider at the second end of the main portion and is configured to extend over the back support edge. The second tab is provided with a flange that extends parallel with and abuts against the back support edge. The flange is formed with a hole that aligns with the elongated slot of the back support edge. A fastener passes through the hole in the flange of each divider and through the elongated slot in the back support edge to adjustably secure the divider to the shelf Each divider may be moved by removing the fastener, placing the second tab adjacent the elongated slot at a desired position and then replacing the fastener.

The shelf includes a side plate that extends downward from the first side of the support plate and reinforces the strength of the shelf. The side plate also extends from the front edge lip to the back support edge and is provided with mounting holes. The side plate also has a curved slot configured to allow the shelf to be mounted in a pivotable manner such that the shelf tilts downward a desired amount.

The present invention is also directed to a method of manufacturing a shelving system with tilting shelves and adjustable dividers. A shelf is made of a sheet of metal flattened to form a support plate that extends in a longitudinal direction from first side to a second side and extends in a lateral direction from a lower front portion to an upper back portion. A front edge lip is formed by bending a portion of the sheet of metal so that the front edge lip extends upwardly from the support plate and extends in the longitudinal direction. A series of slits are formed in the front edge lip either before or after the sheet of metal is bent to form the front edge lip. In a similar manner, another portion of the sheet of metal is bent to form a back support edge along the upper back portion of the support plate. A portion of the back support edge is cut out, preferably with a router, to form an elongated slot extending generally in the longitudinal direction.

A divider is formed from another sheet of metal to include a main portion having a first end and a second end. The sheet of metal is cut to form a first tab attached to the main portion at the first end of the main portion and the sheet of metal is cut to form a second tab attached to the main portion at the second end of the main portion. The second tab is formed with a flange by bending a portion of the second tab. Alternatively, the first and second tabs are formed separately from the main portion and then attached thereto by welding or some other fastening technique. Preferably, a hole is drilled through the flange.

Next, a divider is placed on the support plate. The first tab of the divider is engaged with one of the slits in the front edge lip. A fastener is passed through the hole in the flange of the divider and through the elongated slot in the back support edge to adjustably secure the divider to the shelf. Numerous dividers can be placed on a single shelf.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENTS

Figure 1:
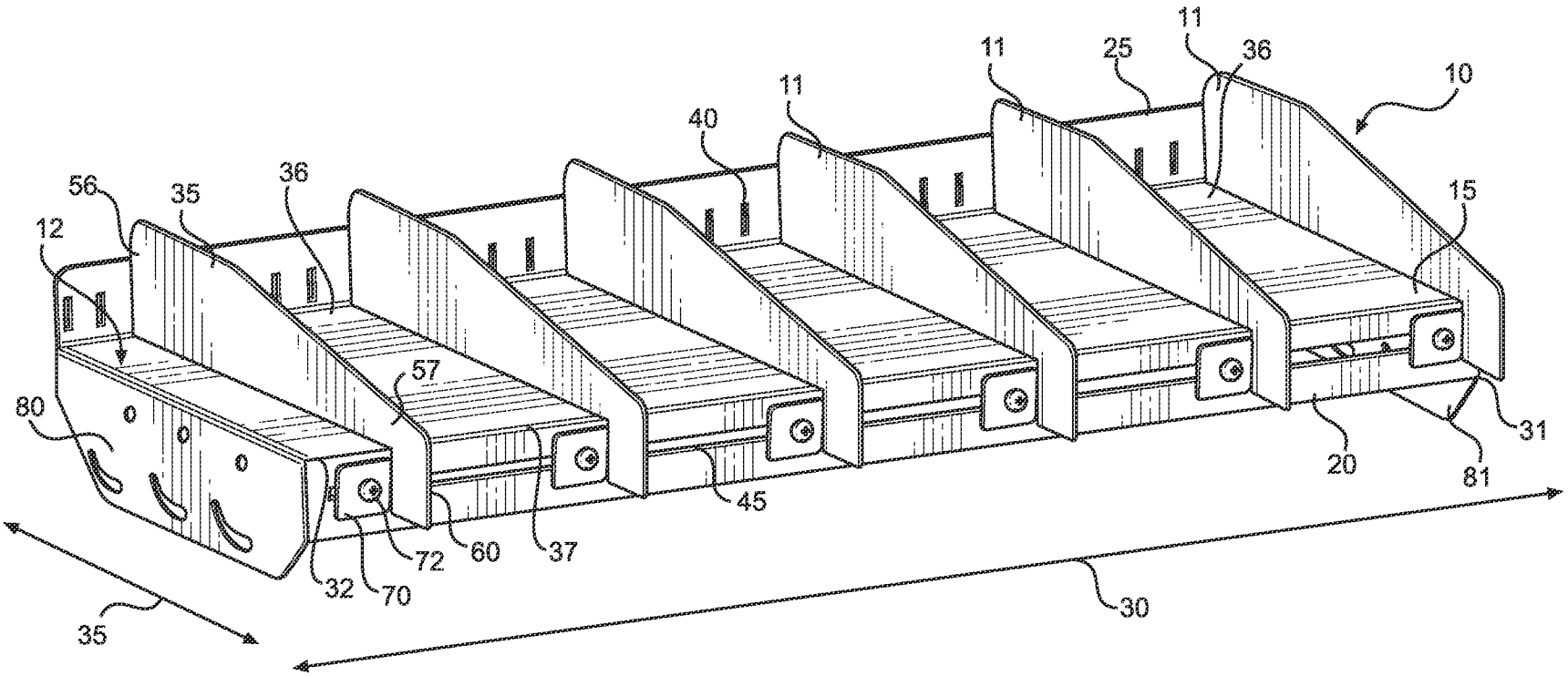
FIG. 1 is a perspective rear top right view of a shelving system showing a tiltable shelf and multiple dividers mounted to the shelf in accordance with a preferred embodiment of the invention.

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to employ the present invention.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

In addition, any specific numerical value listed includes a margin of error of +/−5%. Accordingly, a length of 100 cm includes lengths between 95 and 105 cm. Similarly, the terms "horizontal", "vertical", "parallel" and "perpendicular" are defined as including a margin of error of 5° such that an object need not be perfectly horizontal, for example. The term "approximately" increases these various margins to 10% and 10°.

With initial reference to FIG. 1 there is shown shelving system 10 in accordance with a preferred embodiment of the invention. Shelving system 10 comprises a tiltable shelf 12 including a support plate 15 for holding or storing items (not shown). Shelving system 10 is shown from a top rear perspective to show how dividers 11 connect to shelf 12 at a back support edge 20. Support plate 15 extends in a longitudinal direction 30 from a first side 31 to a second side 32. Support plate 15 also extends in a lateral direction 35 from a lower front portion 36 to an upper back portion 37 such that support plate 15 is tilted forward and items stored on support plate 15 will slide to lower front portion 36. When shelf 12 is mounted, lower front portion 36 would be positioned closer to a user placing items on shelf 12 and back support edge 20 would be mounted next to a wall or at the back of a cart.

A front edge lip 25 is connected to support plate 15. Front edge lip 25 extends in longitudinal direction 30 and rises above support plate 15 to retain items on a support plate surface 39. Front edge lip 25 has a series of slits 40 formed therein. Back support edge 20 is connected to support plate 15 along upper back portion 37 of support plate 15. Upper back support edge 20 has an elongated slot 45 extending generally in longitudinal direction 30. It should be noted that shelf 12 is arranged to show slot 45.

Figure 2:
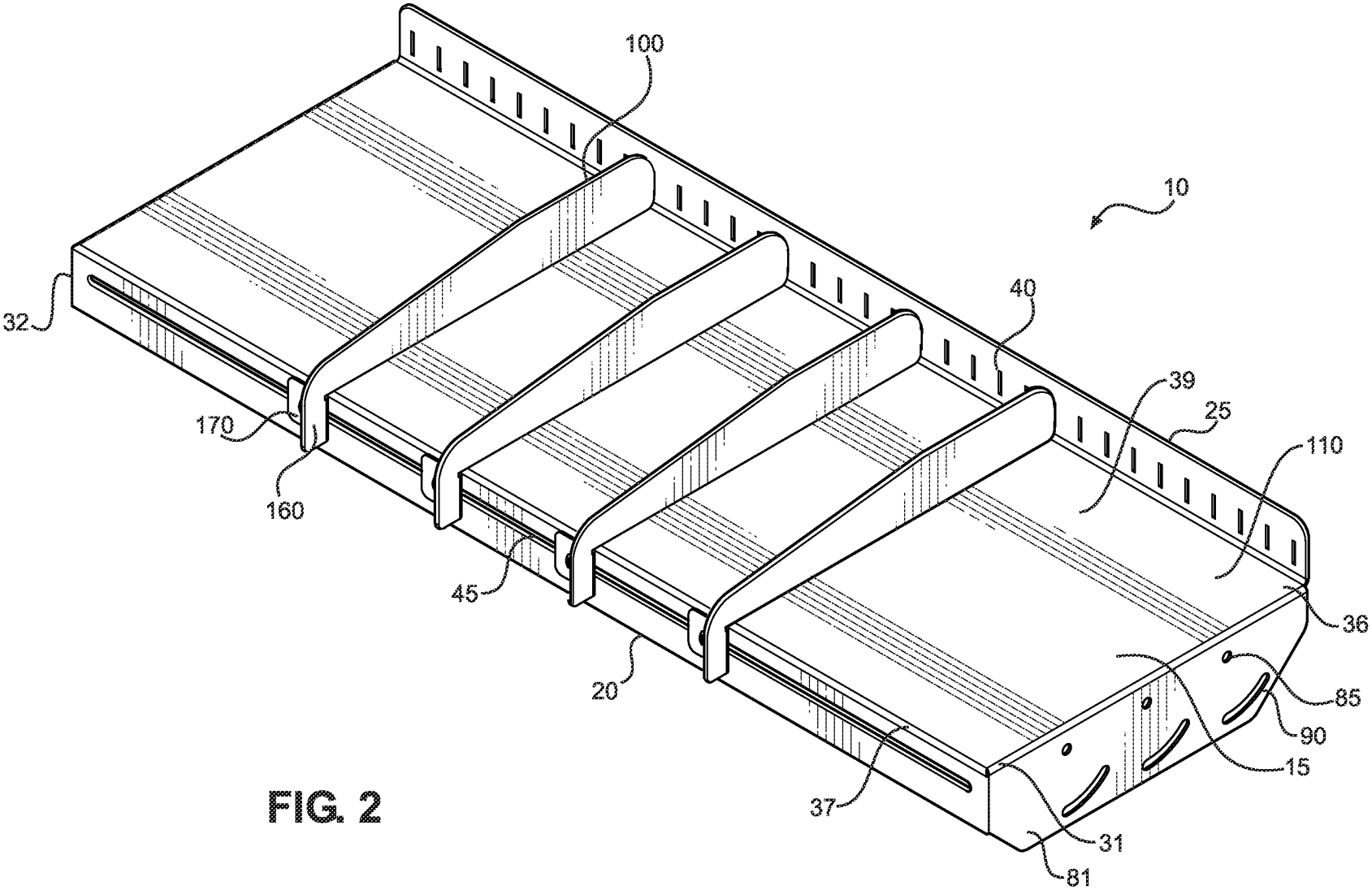
FIG. 2 is a perspective rear top left view of a shelving system in accordance with another embodiment of the invention showing fewer and shorter dividers than those in FIG. 1.
Figure 3:
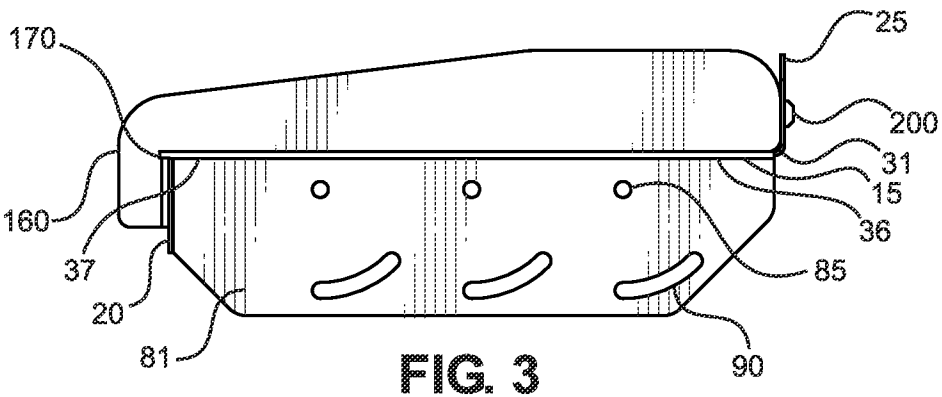
FIG. 3 is a side view of the shelving system of FIG. 2.

Multiple dividers 11 may be mounted on support plate 15. Each divider 11 includes a main portion 55 having a first end 56 disposed at lower front portion 36 of shelf 12 and a second end 57 located at upper back portion 37 of shelf 12. Dividers 11 may extend above front edge lip 25 as shown in FIG. 1 or may be made shorter as shown in FIGS. 2 and 3.

Figure 4:
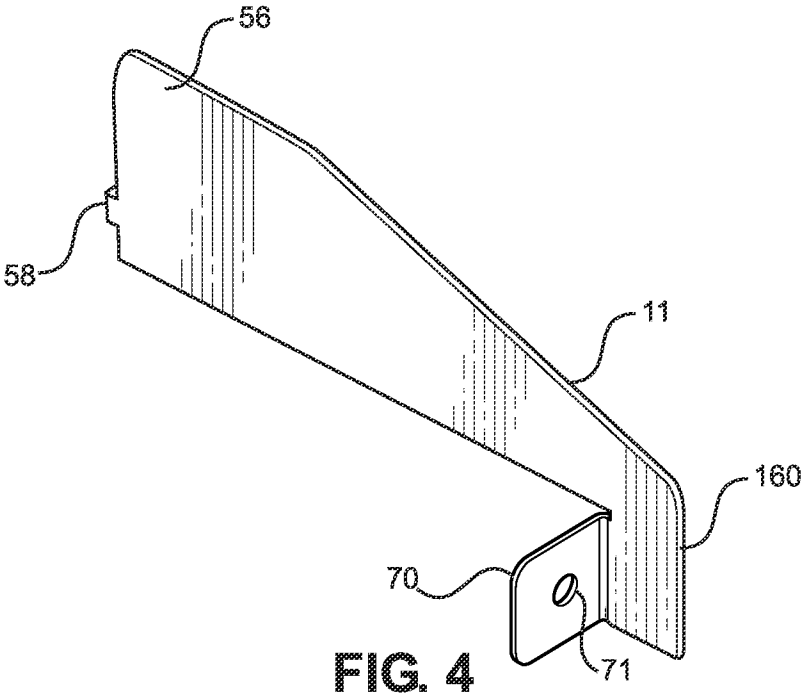
FIG. 4 is a perspective view of a divider of FIG. 1.

FIG. 4 shows a divider 11 separated from shelf 12. As best seen in FIGS. 1 and 4, a first tab 58 is attached to main portion 55 at first end 56 and engages one of slits 40 in front edge lip 25. A second tab 60 is attached to main portion 55 at second end 57 and is configured to extend over back support edge 20. Second tab 60 is provided with a flange 70 that extends parallel with and abuts against back support edge 20. Flange 70 is formed with a hole 71 that aligns with elongated slot 45. A fastener 72 passes through hole 71 in flange 70 in divider 11 and through elongated slot 45 in back support edge 20 to adjustably secure divider 11 to shelf 12. Divider 11 may be moved by removing fastener 72, placing divider tab 60 adjacent elongated slot 45 at a desired position and then replacing fastener 72. As best seen in FIGS. 2 and 3, a short embodiment of the divider, divider 100, still has a second tab 160 extending over back edge support 20, a flange 170 and a first tab 200 extending through one of slits 40.

Figure 5:
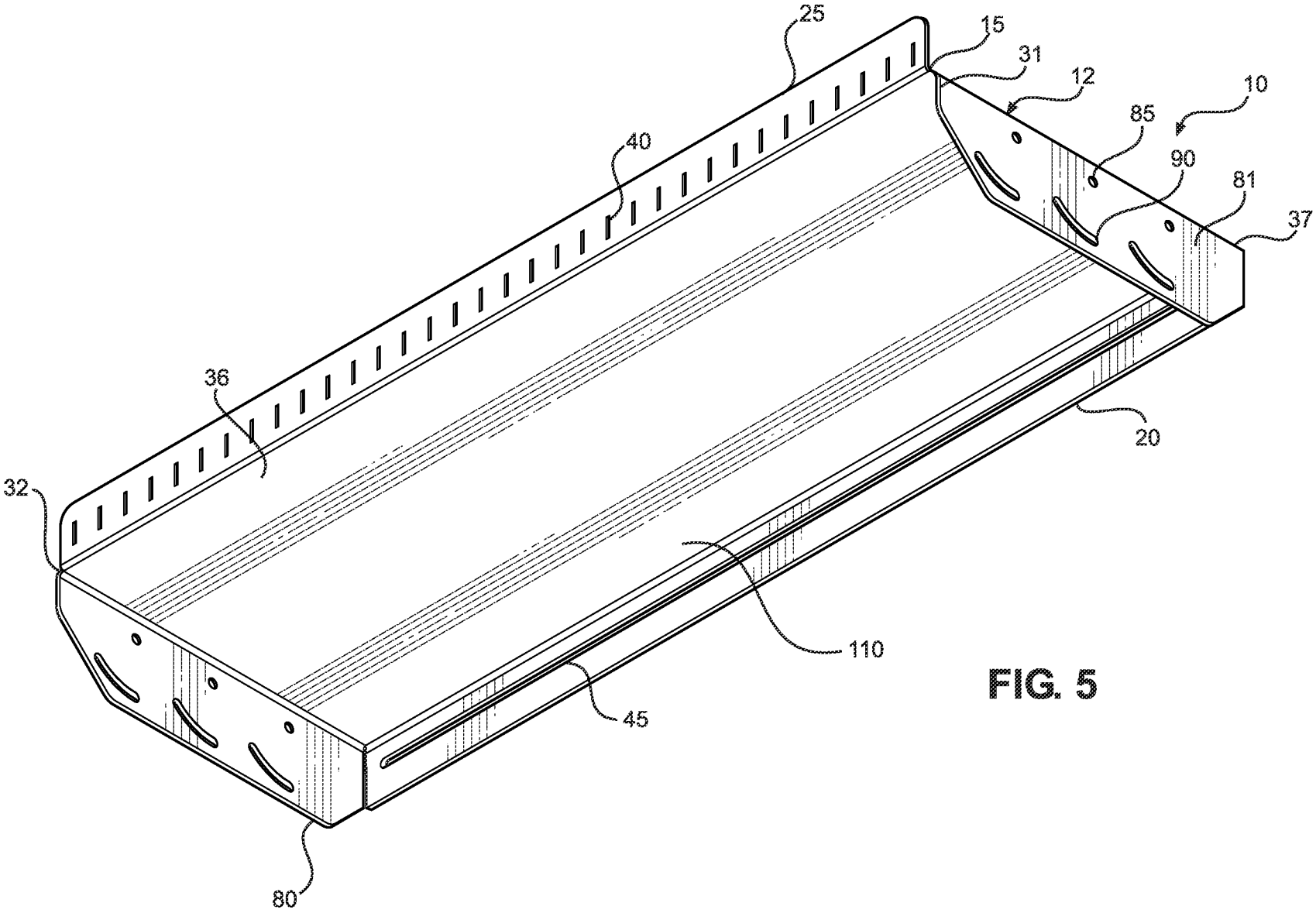
FIG. 5 is a perspective front bottom right view showing the bottom and front of the shelving system of FIG. 1.

As best seen in FIG. 5, shelf 12 includes a side plate 80 that extends downward from first side 32 of support plate 15. Side plate 80 also extends from front edge lip 25 to back support edge 20 and is provided with mounting holes 85. Side plate 80 also has one or more curved slots 90 configured to allow shelf 12 to be mounted in a pivotable manner such that shelf 12 tilts downward a desired amount. An additional side plate 81 is provided at second side 31 and has the same mounting holes 85 and curved slots 90 as side plate 80. Additional portions of the metal sheet are bent to form side plates 80 and 81. Holes 85 and curved slots 90 are formed in side plates 80 and 81 to allow shelf 12 to be tilted.

The invention is also directed to a method of manufacturing shelving system 10. Referring generally to FIGS. 1-5, shelf 12 is made of a sheet of metal 110 flattened to form support plate 15. Front edge lip 25 is formed by bending a portion of the sheet of metal 110 so that front edge lip 25 also extends in the longitudinal direction. Series of slits 40 are formed in front edge lip 25 either before or after sheet 110 is bent to form front edge lip 25. Slits 40 may be formed by cutting or stamping sheet 110. In a similar manner, another portion of sheet 110 is bent to form a back support edge along upper back portion 37 of support plate 15. A portion of back support edge 20 is cut out, preferably with a router to form elongated slot 45 extending generally in longitudinal direction 30.

Divider 11 is formed to include main portion 55 having first end 56 and second end 57. First tab 58 is attached to main portion 55 at first end 56 and second tab 60 is attached to main portion 55 at second end 57. Second tab 60 is formed with flange 70. Preferably hole 71 is drilled through flange 70. First tab 58 and second tab 60 are preferably formed by cutting the shape of divider 11 from a blank (e.g., another sheet of metal) but first and second tabs 58 and 60, respectively, may formed separately from main portion 55 and then be attached to main portion 55 by welding or another similar joining method. Flange 70 preferably formed by bending second tab 60, but again welding or another joining method may be employed to attach flange 70 to second tab 60.

Next divider 11 is placed on support plate 15. First tab 58 is engaged with one of slits 40 in front edge lip 25. Fastener 72 is passed through hole 71 in flange 70 of divider 11 and through elongated slot 45 in back support edge 20 to adjustably secure divider 11 to shelf 12. Numerous dividers can be placed on a single shelf.

Although described with reference to preferred embodiments, it should be readily understood that various changes or modifications could be made to the invention without departing from the spirit thereof. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description. In general, the invention is only intended to be limited by the scope of the following claims.

I claim:

1. A shelving system comprising:

a shelf including a support plate, extending in a longitudinal direction from a first side to a second side and extending in a lateral direction from a front portion to a back portion, a front edge lip connected to the support plate, extending in the longitudinal direction, and having a slit formed therein, and a back support edge connected to the support plate along the back portion of the support plate, the back support edge having an elongated slot extending generally in the longitudinal direction;

a divider mounted on the support plate, the divider including a main portion having a first end and a second end, with a first tab attached to the main portion at the first end and engaging the slit in the front edge lip, and a second tab attached to the main portion at the second end, the second tab being provided with a flange, said flange being formed with a hole; and a fastener passing through the hole in the flange of the divider and through the elongated slot in the back support edge of the shelf to adjustably secure the divider to the shelf.

2. The shelving system of claim 1, wherein the shelf further includes a side plate extending downward from the first end of the support plate and extending from the front edge lip to the back support edge, the side plate being provided with mounting holes.

3. The shelving system of claim 2, wherein the side plate further includes a curved slot configured to allow the shelf to be mounted in a pivotable manner.

4. The shelving system of claim 1, wherein the front edge lip extends along the front portion of the support plate and in an upward direction.

5. The shelving system of claim 4, wherein the support plate is configured to support items and the front edge lip is configured to retain the items on the support plate.

6. The shelving system of claim 5, wherein the front edge lip has a series of slits formed therein and the slit the first tab of the divider engages is one of the series of slits.

7. The shelving system of claim 6, further comprising a series of dividers, with each divider mounted in one of the series of slits.

8. The shelving system of claim 1, wherein the back support edge extends in the longitudinal direction and extends in a downward direction.

9. The shelving system of claim 1, wherein divider extends in the lateral direction from the front edge lip to the back support edge.

10. The shelving system of claim 1, wherein the first tab extends in the lateral direction.

11. The shelving system of claim 10, wherein the second tab extends in a downward direction.

12. The shelving system of claim 11, wherein the flange extends in the longitudinal direction.

13. A method of manufacturing a shelving system comprising:

providing a shelf including a support plate, extending in a longitudinal direction from a first side to a second side and extending in a lateral direction from a front portion to a back portion, a front edge lip connected to the support plate, extending in the longitudinal direction and having a slit formed therein, and a back support edge connected to the support plate along the back portion of the support plate, the back support edge having an elongated slot extending generally in the longitudinal direction;

placing a divider on the support plate, the divider including a main portion having a first end and a second end, with a first tab attached to the main portion at the first end and a second tab attached to the main portion at the second end, the second tab being provided with a flange, said flange being formed with a hole;

engaging the first tab with the slit in the front edge lip; and passing a fastener through the hole in the flange of the divider and through the elongated slot in the back support edge of the shelf to adjustably secure the divider to the shelf.

14. The method according to claim 13, wherein providing the shelf includes flattening a sheet of metal to form the support plate.

15. The method according to claim 14, wherein providing the shelf further includes bending a portion of the sheet of metal to form the front edge lip and cutting the slit into the front edge lip.

16. The method according to claim 15, wherein providing the shelf further includes bending another portion of the sheet of metal to form the back support edge and forming the elongated slot in the back support edge.

17. The method according to claim 16, wherein providing the shelf further includes bending two additional portions of the sheet of metal to form side plates.

* * * * *